US006893267B1

(12) United States Patent
Yueh

(10) Patent No.: US 6,893,267 B1
(45) Date of Patent: May 17, 2005

(54) USB PLUG WITH A MULTI-DIRECTIONAL ROTATION STRUCTURE

(76) Inventor: Wen Hsiang Yueh, 3F, No. 7-2, Lane 46, Chung Cheng St., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 10/720,240

(22) Filed: Nov. 25, 2003

(51) Int. Cl.[7] ..... H01R 39/00

(52) U.S. Cl. ..... 439/8; 439/954

(58) Field of Search ..... 439/8, 13, 21, 439/954

(56) References Cited

U.S. PATENT DOCUMENTS 886,262 A * 4/1908 Smith ..... 439/8
2,971,178 A * 2/1961 Reesby ..... 439/8
4,533,796 A * 8/1985 Engelmore ..... 439/24
6,547,602 B2 * 4/2003 Price et al. ..... 439/638
2004/0105329 A1 * 6/2004 Lin et al. ..... 365/202

* cited by examiner

*Primary Examiner*—Gary Paumen
*Assistant Examiner*—James R. Harvey
(74) *Attorney, Agent, or Firm*—Rosenberg, Klein & Lee

(57) ABSTRACT

A USB plug with a multi-directional rotation structure, adopted for a portable electronic device, is used for mating with an electronic product having a USB port. The USB plug has a first hollow spherical housing, and a second hollow spherical housing having an internal diameter longer than an external diameter of the first hollow spherical housing for the first hollow spherical housing to be partially wrapped in the second hollow spherical housing. The first hollow spherical housing contacts and slides on the second hollow spherical housing, and adjusts a relative displacement therebetween so as to the second hollow spherical housing rotates in multiple directions. The second hollow spherical housing can be manipulated with no angular limitations, and therefore objects of orientating the USB plug in a suitable attitude and resolving an arrangement of peripheral apparatuses mating with the electronic product are achieved.

7 Claims, 7 Drawing Sheets

USB PLUG WITH A MULTI-DIRECTIONAL ROTATION STRUCTURE

BACKGROUND OF THE INVENTION

1. Field of the Invention

The present invention relates to a USB plug with a multi-directional rotation structure. More particularly, the present invention relates to a USB plug with a multi-directional rotation structure, adopted for a portable electronic device and being manipulated with no angular limitations.

2. Background of the Invention

The USB (Universal Serial Bus) interface, which has functions of PNP (Plug and Play), hot insertion/hot swapping and the like, is the most popular data transmission interface applied for peripheral devices nowadays. More and more peripheral devices include a USB interface to increase the expandability thereof for various applications.

Referring to FIG. 1, a conventional electronic product 71 has a plurality of USB ports 81 disposed therein and arranged in a spaced manner. The conventional electronic product 71 usually is just applicable for a plurality of conventional cables 51 respectively having at least one USB interface to plug at the same time. If there is a need to plug in a plurality of conventional portable electronic devices 61, each having at least one USB interface and a fixed volume, the USB ports 81 cannot be used completely because that there is insufficient space to plug in the conventional portable electronic devices 61 at the same time.

With respect to FIG. 2 and FIG. 3, a conventional USB plug can be improved to provide a rotation structure adjustable for various objects. In FIG. 2, a first conventional rotational USB plug 1 with an X-axis rotation includes a body 11, a first mating face 14 disposed on an edge of the body 11, a plug 12 connecting the body 11, a second mating face 15 disposed on an edge of the plug 12 and corresponding to the first mating face 14, a USB interface 121 formed on an opposing edge of the plug 12, and a pivot 13 vertically disposed both on the first mating face 14 and the second mating face 15. The first conventional rotational USB plug 1 uses the pivot 13 (X-axis), which is rotated around by the plug 12, and provides an adjustable attitude.

As illustrated in FIG. 3, a second conventional rotational USB plug 2 with a Y-axis rotation, includes a body 21, a first mating face 24 disposed on an edge of the body 21, a plug 22 connecting the body 21, a second mating face 25 disposed on an edge of the plug 22 and corresponding to the first mating face 24, a USB interface 221 formed on an opposing edge of the plug 22, and a pivot 23 parallel connecting both the first mating face 24 and the second mating face 25. The second conventional rotational USB plug 2 uses the pivot 23 (Y-axis), which is rotated around by the plug 22, and provides an adjustable attitude.

However, the first conventional rotational USB plug 1 and the second conventional rotational USB plug 2 mentioned above can be used around only one axis (respectively around the X-axis and the Y-axis) and are restricted in other directions. The first conventional rotational USB plug 1 and the second conventional rotational USB plug 2 cannot be used with electronic products and computers having a plurality of USB ports in various ways.

SUMMARY OF INVENTION

The object of the invention is therefore to provide a USB plug with a multi-directional rotation structure adopted for a portable electronic device and mating with an electronic product having a USB port. The USB plug includes a first hollow spherical housing and a second hollow spherical housing relative to the first hollow spherical housing, and uses an internal diameter of the second hollow spherical housing longer than an external diameter of the first hollow spherical housing for the first hollow spherical housing partially wrapped in the second hollow spherical housing. The first hollow spherical housing has a retaining rim sliding and in contact with the second hollow spherical housing for adjusting a relative displacement therebetween, and thus the second hollow spherical housing can be manipulated with no angular limitations and rotated in multiple directions.

According to the invention, this object is achieved by a USB plug with a multi-directional rotation structure, adopted for a portable electronic device. The invention is used for mating with an electronic product having a USB port. The USB plug with a multi-directional rotation structure, includes a main body, a USB mating body relative to the main body, a USB interface disposed on an end of the USB mating body, a first hollow spherical housing connecting the main body, and a second hollow spherical housing connecting the USB mating body. The present invention uses an internal diameter of the second hollow spherical housing longer than an external diameter of the first hollow spherical housing for the first hollow spherical housing partially wrapped in the second hollow spherical housing. The second hollow spherical housing includes an aperture diameter shorter than the external diameter of the first hollow spherical housing to prevent the second hollow spherical housing from escaping out of the first hollow spherical housing. The first hollow spherical housing has a retaining rim sliding on and contacting the second hollow spherical housing for adjusting a relative displacement therebetween, and thus the second hollow spherical housing can be manipulated with no angular limitations and rotated in multiple directions. The objects for orientating the USB plug in a suitable attitude and resolving an arrangement of peripheral apparatuses mating with the electronic product are therefore achieved.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EMBODIMENTS

Figure 1:
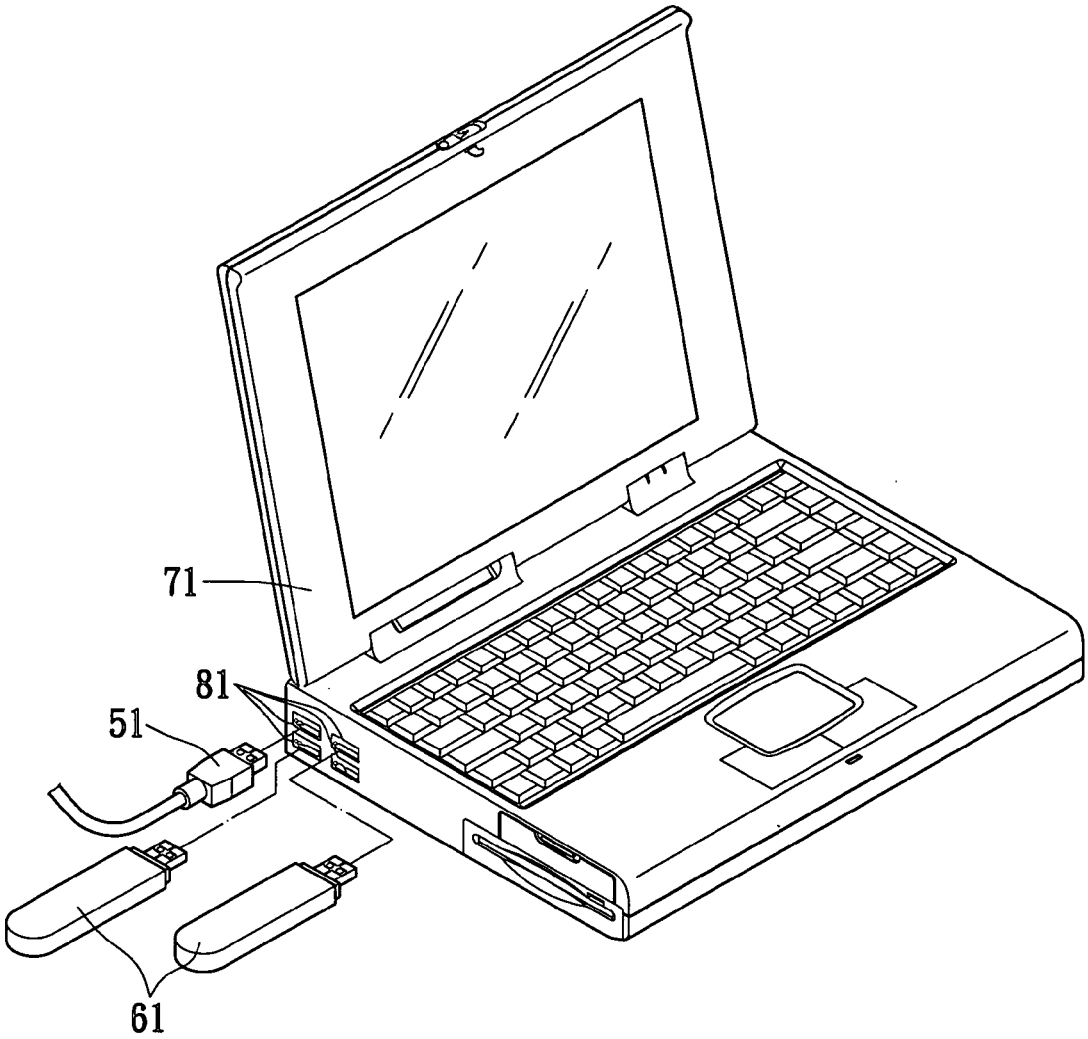
FIG. 1 PRIOR ART
FIG. 1 is a perspective view of an application of conventional rotational USB plug products.
Figure 2:
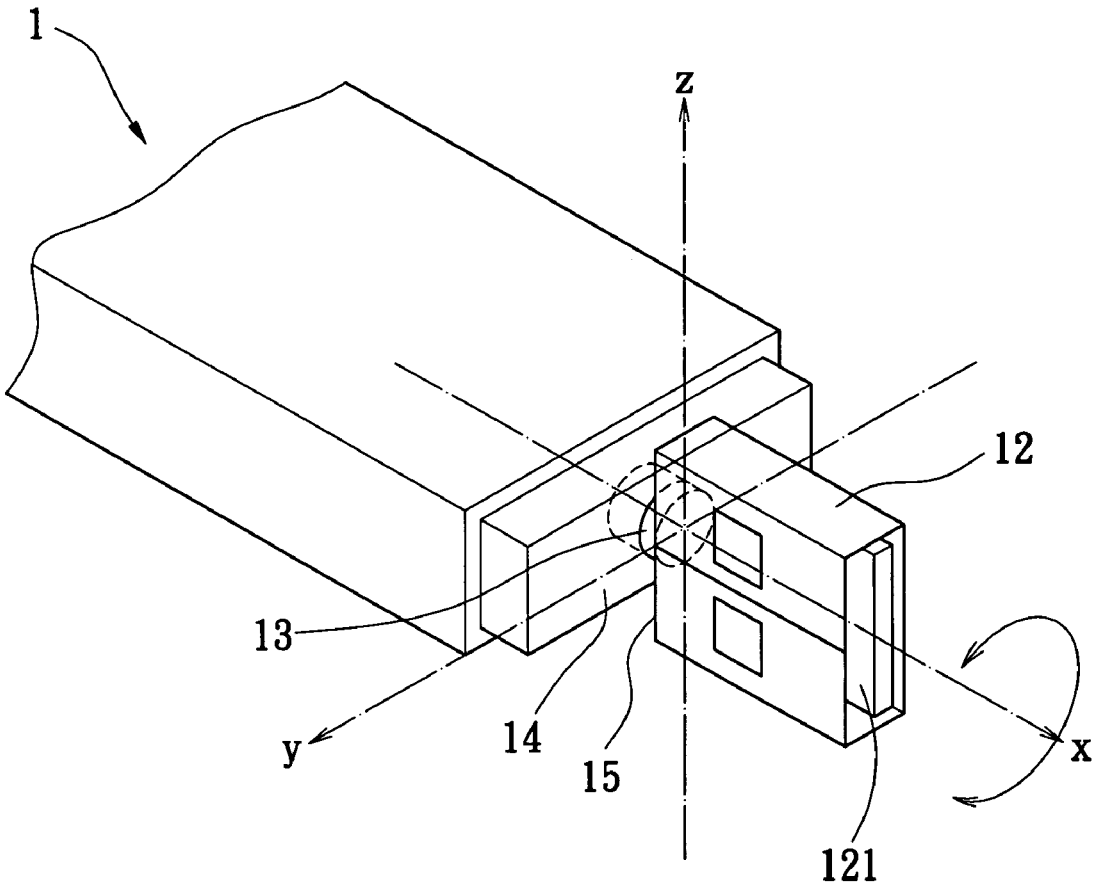
FIG. 2 PRIOR ART
FIG. 2 is a perspective view of a first conventional rotational USB plug.
Figure 3:
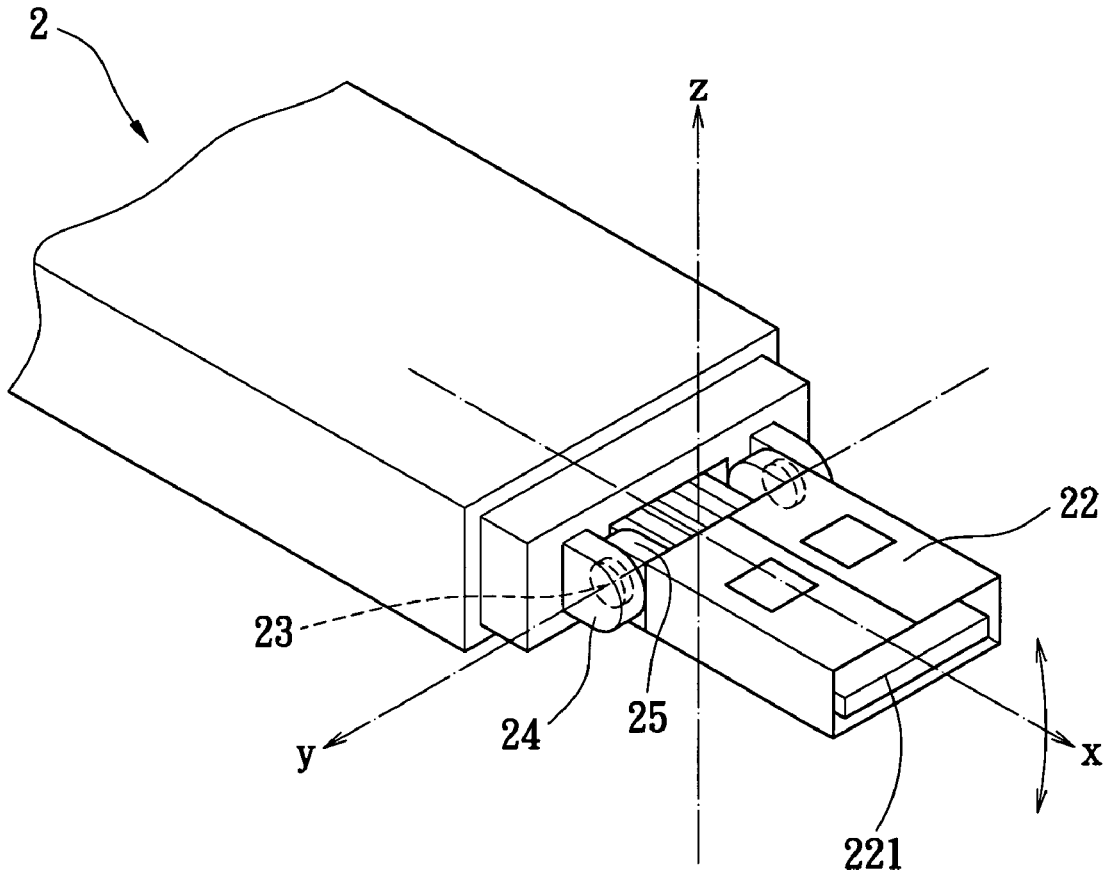
FIG. 3 PRIOR ART
FIG. 3 is a perspective view of a second conventional rotational USB plug.
Figure 4:
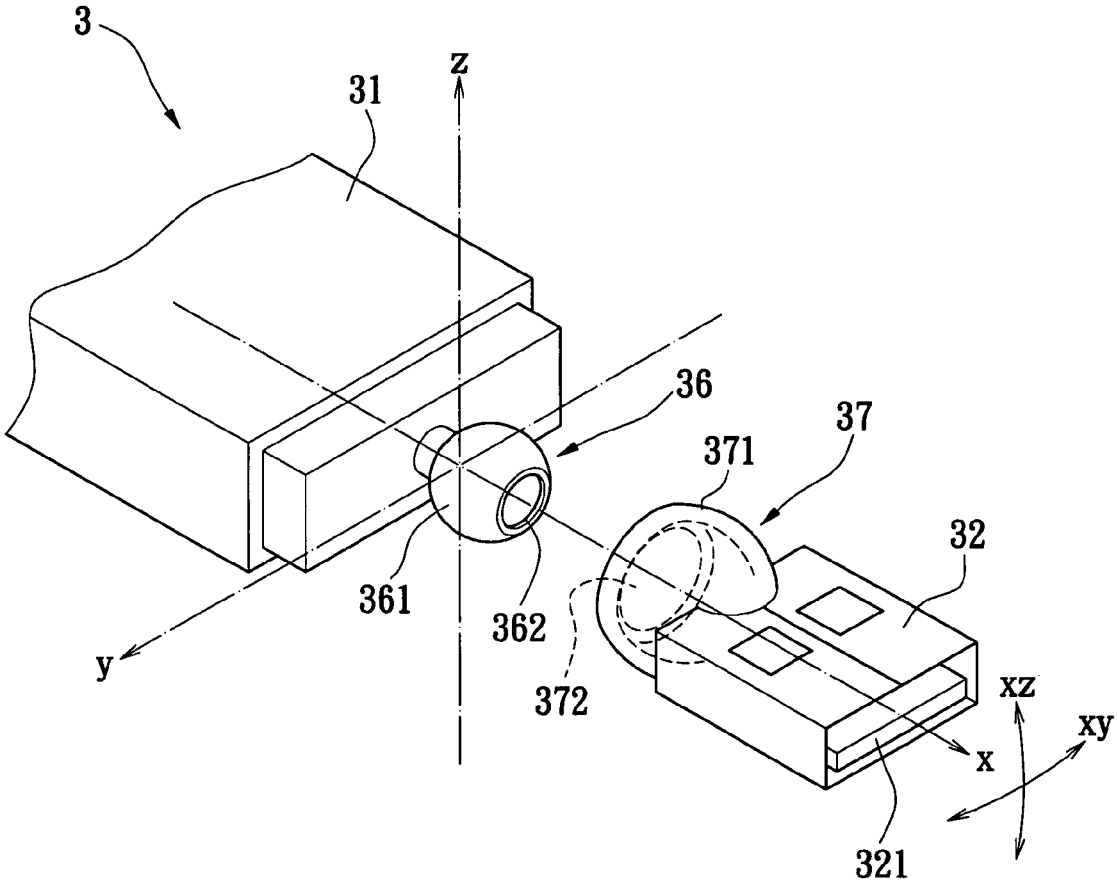
FIG. 4 is a perspective view of a USB plug with a multi-directional rotation structure according to the present invention.
Figure 5:
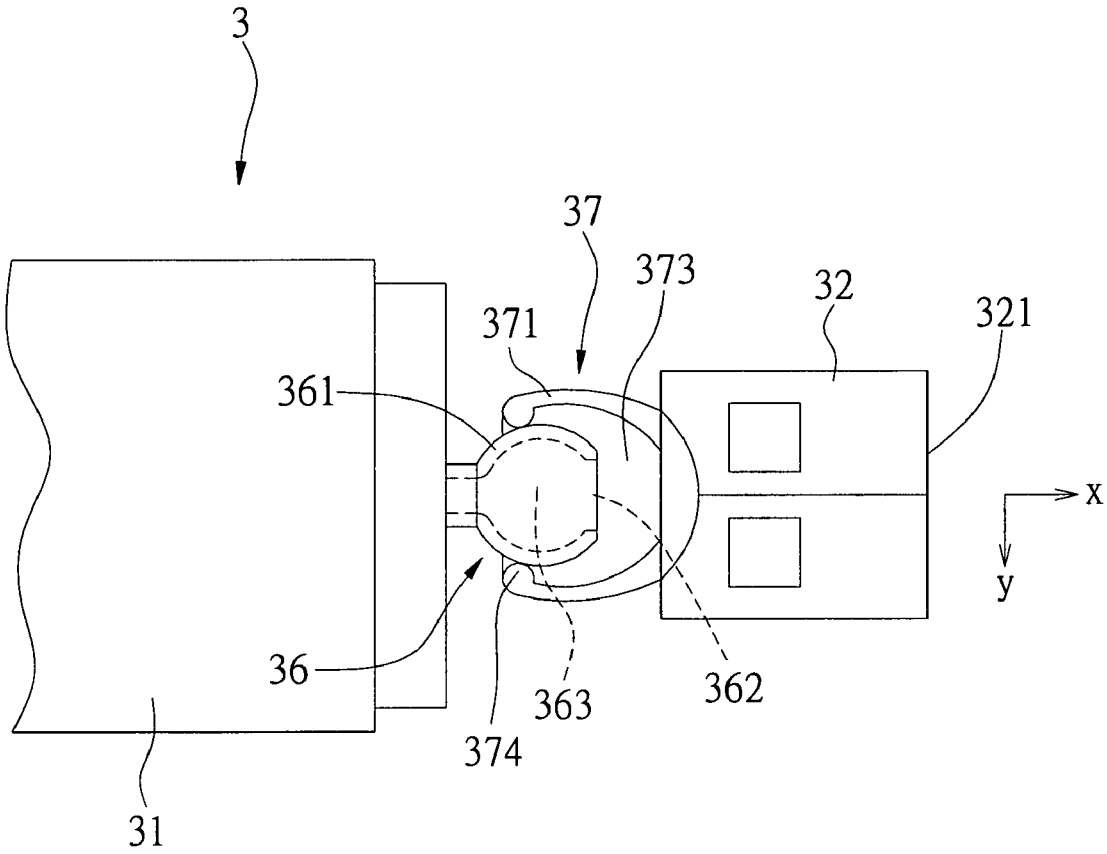
FIG. 5 is an X-Y plane profile of the USB plug with a multi-directional rotation structure according to the present invention.
Figure 6:
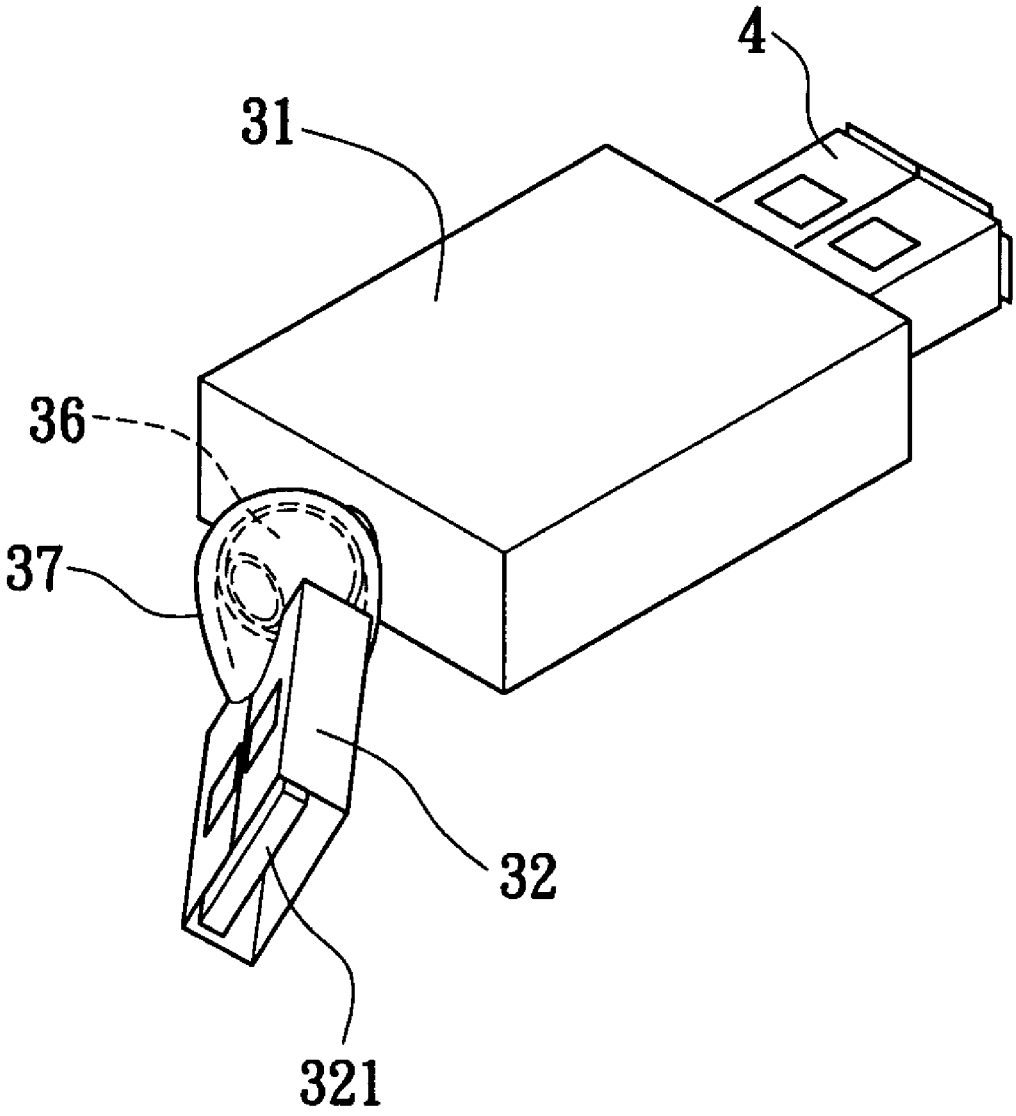
FIG. 6 is a perspective view of a rotational motion of the USB plug with a multi-directional rotation structure according to the present invention.

Referring to FIG. 4 to FIG. 7, the present invention provides a USB plug 3 with a multi-directional rotation structure, adopted for a portable electronic device 6 (shown in FIG. 7) and mating with an electronic product 7 having a USB port 8. With reference to FIG. 4, the USB plug 3 with a multi-directional rotation structure includes a main body 31 and a USB mating body 32 relative to the main body 31, in which the main body 31 is a portable electronic device 6, or as illustrated in FIG. 6, the main body 31 is a USB adapter having at least one data transmission interface 4.

As illustrated in FIG. 4, the main body 31 includes a first pivotal portion 36 connecting on an end thereof. The first pivotal portion 36 has a first hollow spherical housing 361 and a first mating portion 362 formed on a free end of the first hollow spherical housing 361. The USB mating body 32 has a second pivotal portion 37 relative to the first pivotal portion 36, and a USB interface 321 disposed on an opposite end of the USB mating body 32. The USB interface 321 corresponds to and mates with the USB port 8 of the electrical product 7. The second pivotal portion 37 includes a second hollow spherical housing 371 and a second mating portion 372 formed on a free end of the second hollow spherical housing 371. The second hollow spherical housing 371 has an internal diameter longer than an external diameter of the first hollow spherical housing 361, and the second hollow spherical housing 371 is loosely matched with the first hollow spherical housing 361 for the first hollow spherical housing 361 partially and loosely wrapped in the second hollow spherical housing 371.

The second hollow spherical housing 371 has an aperture diameter adjacent to the second mating portion 372 and shorter than the external diameter of the first hollow spherical housing 361 to prevent the second hollow spherical housing 371 escaping out of the first hollow spherical housing 361. The second hollow spherical housing 371 has a retaining rim 374 sliding on and contacting the first hollow spherical housing 361 for adjusting a relative displacement therebetween; thus the second hollow spherical housing 371 can be manipulated with no angular limitations and rotated in multiple directions (see FIG. 5).

With respect to FIG. 5, the first hollow spherical housing 361 has a first cavity 363 formed therein communicating with a second cavity 373 formed in the second hollow spherical housing 371, so that a plurality of electrical cables (not identified) penetrate through the main body 31 and the USB mating body 32 and electrically connect the main body 32 and electrically connect the main body 31 and the USB interface 321.

Figure 7:
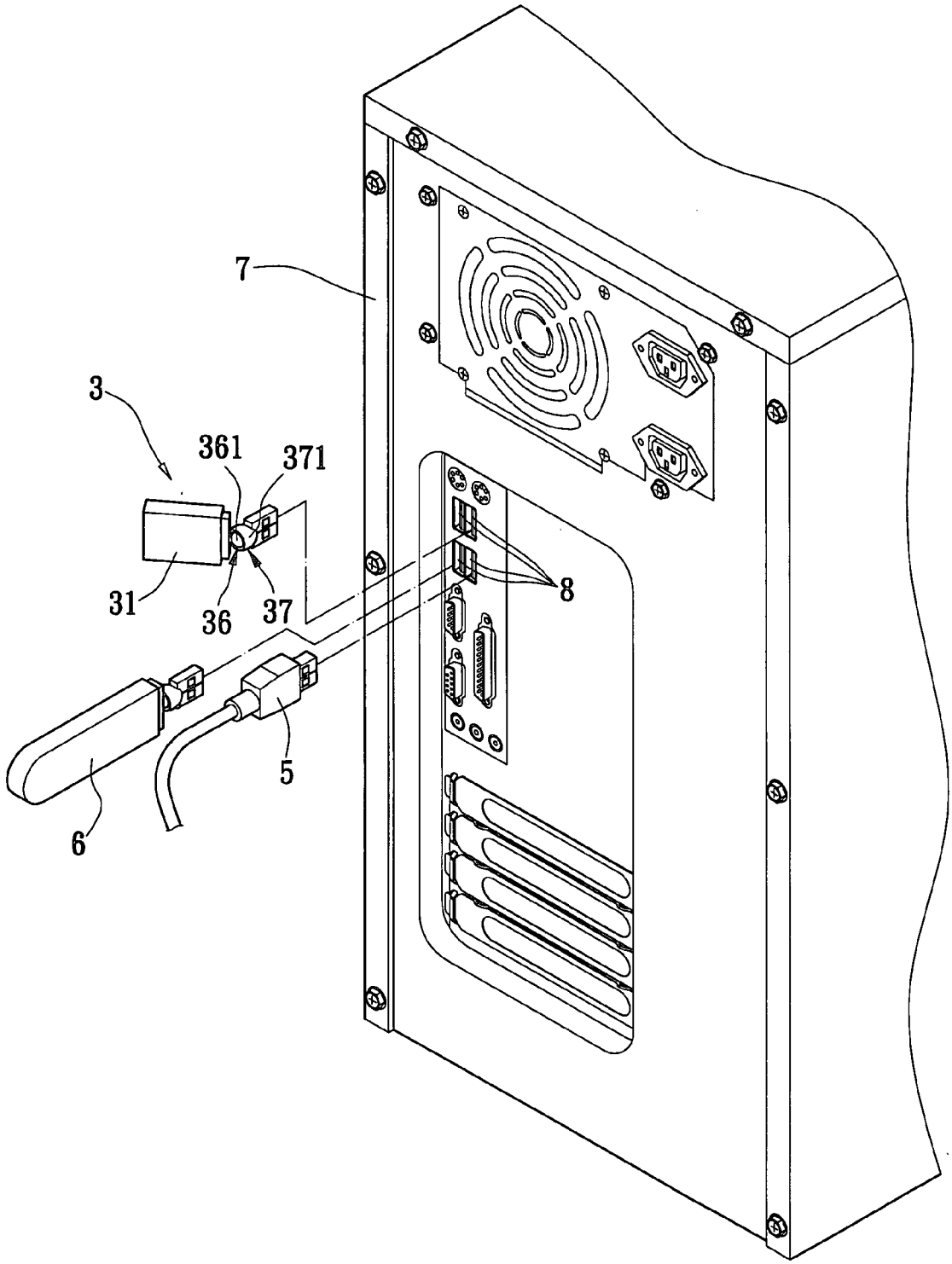
FIG. 7 is a perspective view of an application of the USB plug with a multi-directional rotation structure according to the present invention.

Referring to FIG. 7, the present invention uses the internal diameter of the second hollow spherical housing 371 longer than the external diameter of the first hollow spherical housing 361, and the first hollow spherical housing 361 contacting and sliding on the second hollow spherical housing 371 to adjust a relative displacement therebetween for the second hollow spherical housing 371 rotating in multiple directions. The second hollow spherical housing 371 can be manipulated with no angular limitations, and the USB plug 3 can be orientated in a suitable attitude. Therefore, peripheral apparatuses having at least one USB interface, such as the cables 51, the portable electronic device 6, and the USB plug 3, can respectively mate with USB ports 8 of the electronic product 7 in a one-to-one manner, and be inserted and swapped at the same time.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A USB plug with a multi-directional rotation structure, adopted for a portable electronic device and mating with an electronic product having a USB port; the USB plug comprising:

a main body having a first pivotal portion connecting an end thereof, the first pivotal portion including a first hollow housing having semi-spherical inner and outer surfaces, and a first mating portion formed on a free end of the first hollow housing; and a USB mating body relative to the main body, and having a second pivotal portion connecting an end thereof and a USB interface disposed on an opposite end thereof; the second pivotal portion corresponding to the first pivotal portion, and the USB interface being relative to the USB port of the electrical product, wherein the second pivotal portion includes a second hollow housing having semi-spherical inner and outer surfaces and a second mating portion formed on a free end of the second hollow housing; wherein the second hollow housing has an internal diameter longer than an external diameter of the first hollow housing, and the second hollow housing is loosely matched with the first hollow housing for the first hollow housing to be wrapped partially and loosely inside the second hollow housing;

the second hollow housing has an aperture diameter formed concentrically with the second mating portion and shorter than the external diameter of the first hollow housing, in order to prevent the second hollow housing from escaping out of the first hollow housing; and the second hollow housing has a retaining rim contacting and sliding on the first hollow housing for adjusting a relative displacement therebetween, whereby the second hollow housing can be manipulated with no angular limitations and rotated in multiple directions.

2. The USB plug of claim 1, wherein the first hollow housing has a first cavity formed therein communicating with a second cavity formed in the second hollow housing, and a plurality of electrical cables penetrate through the main body and the USB mating body and electrically connect the main body and the USB interface.

3. The USB plug of claim 1, wherein the main body is a portable electronic device.

4. The USB plug of claim 1, wherein the main body is a USB adapter having at least one data transmitting interface.

5. A USB plug with a multi-directional rotation structure, adopted for a portable electronic device and comprising:

two hollow housings, each having semi-spherical inner and outer surfaces mating with each other and defining a first hollow housing and a second hollow housing, the first hollow housing having a first opening formed in an end thereof, and the second hollow housing including a second opening formed in an end thereof and relative to the first opening; wherein:

the second hollow housing has an internal diameter longer than an external diameter of the first hollow housing, and the second hollow housing is loosely matched with the first hollow housing for the first hollow housing being wrapped partially and loosely inside the second hollow housing; and the second hollow housing has an aperture diameter formed concentrically with the second opening and shorter than the external diameter of the first hollow housing, in order to prevent the second hollow housing from escaping out of the first hollow housing;

whereby the first hollow housing contacts and slides on the second hollow housing for adjusting a relative displacement therebetween, and one of the two hollow housings is manipulated with no angular limitations and rotated around the other in multiple directions; and at least one USB interface disposed on one of the two hollow housings for mating with an electronic product having a USB port.

6. The USB plug of claim 5, wherein one of the two hollow housings is a portable electronic device.

7. The USB plug of claim 5, wherein one of the two hollow housings is a USB adapter having at least one data transmitting interface.

* * * * *